United States Patent [19]

Burgas

[11] 4,305,265

[45] Dec. 15, 1981

[54] LAUNDERING DEVICE

[76] Inventor: Marcelo Burgas, 6750 SW. 8th St., Lot F 601, Miami, Fla. 33144

[21] Appl. No.: 162,045

[22] Filed: Jun. 23, 1980

[51] Int. Cl.[3] ..... D06F 1/00

[52] U.S. Cl. ..... 68/122; 68/96; 68/213

[58] Field of Search ..... 68/21, 43, 48, 50, 53, 68/94, 96, 110, 112, 122, 125, 132, 147, 213, 214, 215, 216, 217, 232, 242

[56] References Cited

U.S. PATENT DOCUMENTS 3,206,952 9/1965 McCarthy ..... 68/96 X

*Primary Examiner*—Philip R. Coe

*Attorney, Agent, or Firm*—John Cyril Malloy

[57] ABSTRACT

A laundering device for use in cleaning articles of clothing composed of a plurality of components adapted to be disassembled when not in use and stored in a container, the device is composed of a frame with downwardly extending removable support legs and a reciprocal shaft including either a motor drive or hand drive for reciprocating the shaft so that when the lower end, which extends between the legs is reciprocated within a flexible pliable bag of soapy water impervious material, a plunger attached to the shaft agitates the water so that the articles of clothing may be laundered.

6 Claims, 4 Drawing Figures

LAUNDERING DEVICE

FIELD OF THE INVENTION

This invention relates to a laundering device and more particularly to a laundering device which is adapted to be utilized in small apartments and, when not in use, is adapted to be broken down for storage in a compact unit.

BACKGROUND OF THE INVENTION

As is perhaps well known there is a substantial increase in the numbers of persons living in urban areas. This necessitates many people living in apartments. In such apartments there is often not room for a washing machine. Many times persons living in such apartments have small articles of clothing to be laundered. This invention is of a convenient device which may be used, for example, in the bathtub to launder clothes. it is composed of a plurality of parts which are adapted to be broken down and stored conveniently in a container resembling a suitcase.

OBJECTS OF THE INVENTION

Generally speaking, it is an object of this invention to provide a laundering device which is composed of a frame having downwardly extending legs and reciprocably on the frame a shaft is provided for movement vertically between the legs with an upper portion of the shaft being connected within a housing to a motor or other suitable drive means so that the shaft may be reciprocated with the lower end being within a bag and provided with a plunger so that the bag, which is of pliable plastic material may be tied to the shaft and be utilized as a vessel for soapy water to launder clothing. For example, the device can be utilized in a bathtub conveniently.

In accordance with these and other objects which will become apparent hereinafter, the instant invention will now be described with reference to the accompanying drawings in which:

DESCRIPTION OF THE PREFERRED EMBODIMENT

Figure 1:
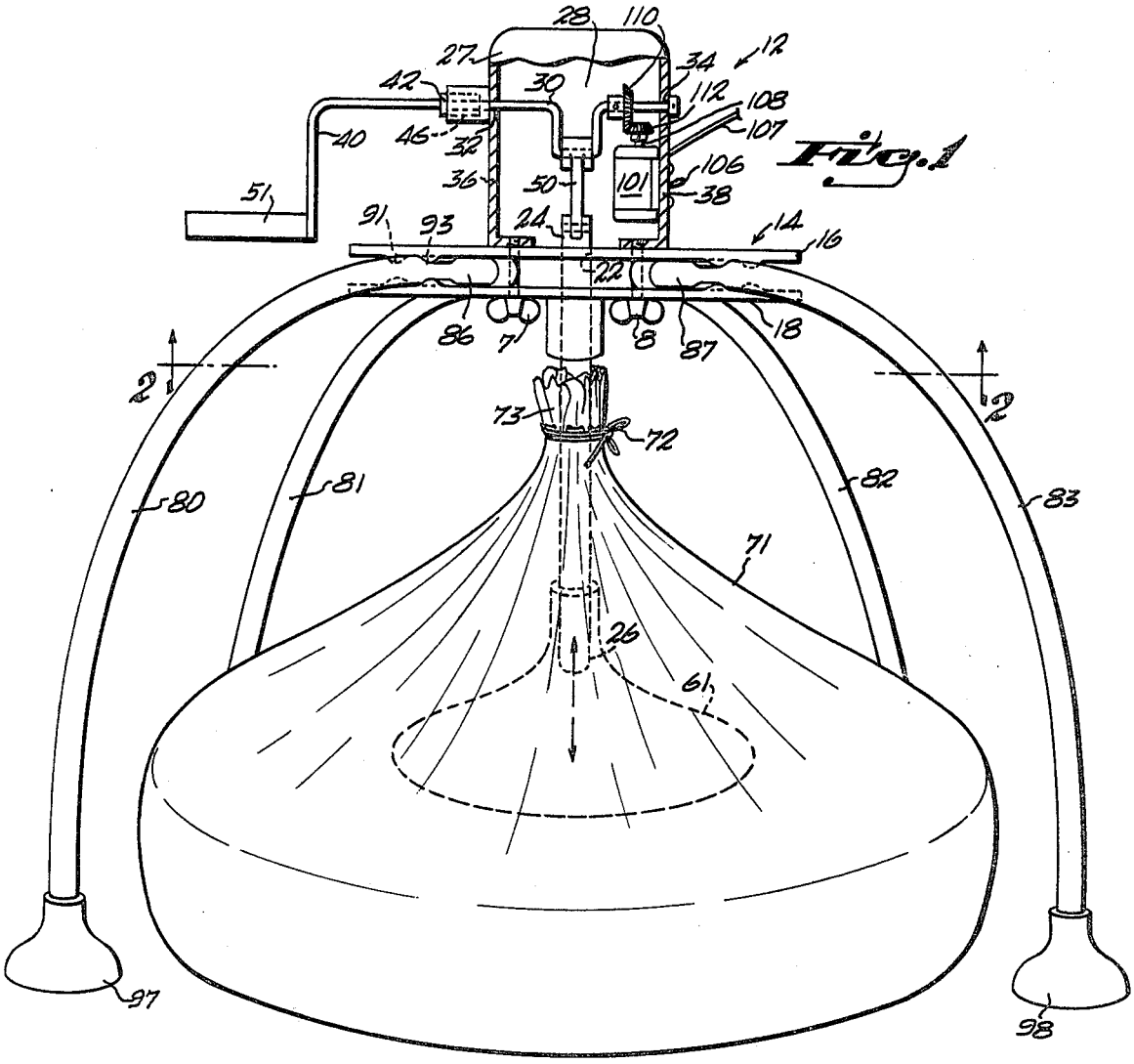
FIG. 1 is an elevation view partly in cross section illustrating the laundry device of the instant invention.
Figure 2:
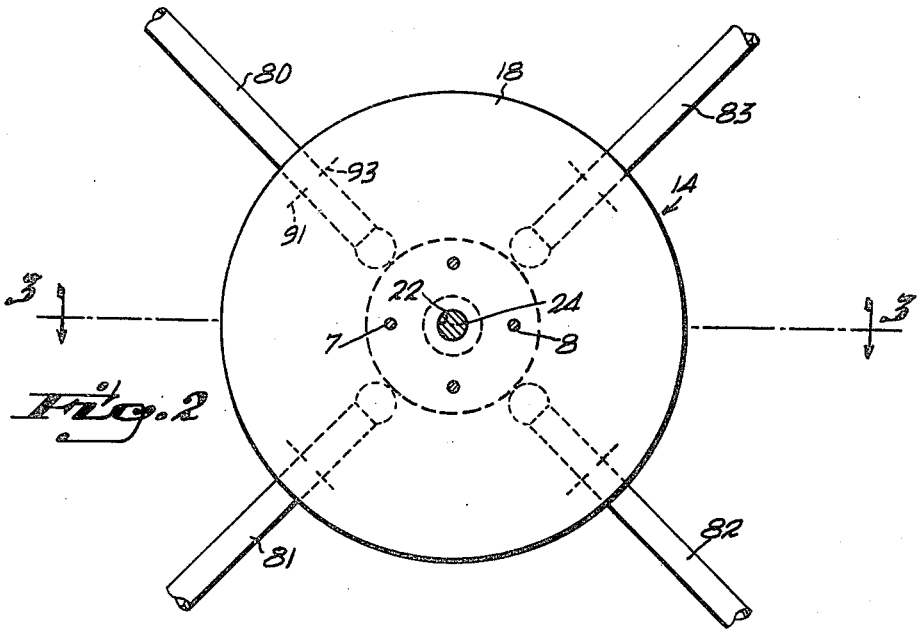
FIG. 2 is a plan view taken on the plane indicated by the line 2—2 of FIG. 1 and looking in the direction of the arrows.
Figure 3:
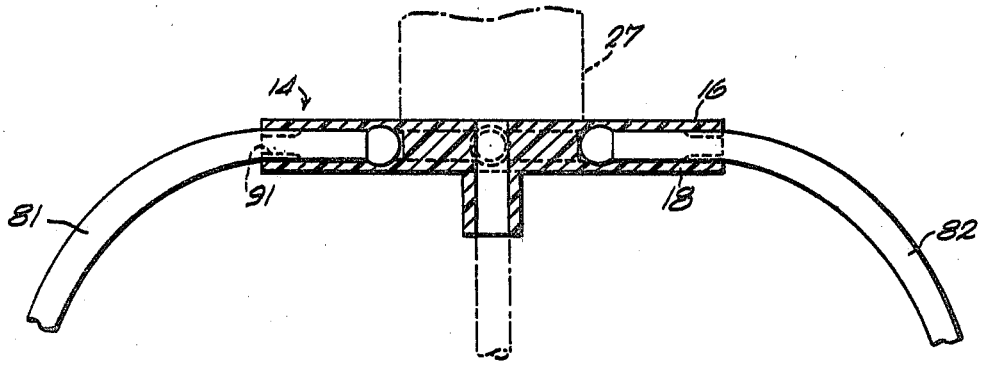
FIG. 3 is a view in cross section taken on the plane indicated by the line 3—3 of FIG. 2 and looking in the direction of the arrows.

Referring to the drawings wherein like reference characters designate like or corresponding parts throughout the several views and referring particularly to FIG. 1, the numeral 12 generally designates a laundering device. It is composed of a frame which is generally designated by the numeral 14 and which is seen to be composed of a plate means having an upper horizontal plate 16 and a lower horizontal plate 18 spaced from one another a predetermined distance. The plate also has a central through opening as at 22. A shaft, having an upper portion 24 and a lower portion 26, is slidably arranged within this hole. About the upper portion of the shaft a housing generally designated by the numeral 27 is provided. It is seen that this housing defines an inner chamber 28 which is spanned at the upper zone by a crank shaft designated by the numeral 30 which is journaled for rotation through holes 32 and 34 in the opposite side walls 36 and 38 of the housing. A crank arm 40 may be provided and removably attached, as by the fitting 42 being received within the socket 46 and keyed for rotation. Through the connector 50 the crank shaft 30 is connected to the upper portion of the shaft within the housing. It is thus seen that when the handle 51 is rotated, the shaft will assume a reciprocal motion. This will cause the lower portion 26 of the shaft to reciprocate up and down. To the lower portion of the shaft a plunger 61 is connected as by the snug fit shown in FIG. 1. About the shaft a water impervious bag 71 is arranged and tied to the shaft for reciprocal movement of it as by the tie means 72 at the gathered top 73 of the bag. The plate means of the frame and the housing removably fixed to the plate means as by bolts 7 and 8 are supported on a plurality of legs 80, 81, 82, and 83 which have their upper ends captivated as at 86 and 87 between the two plates of the plate means as can be seen in FIGS. 1 and 3. Preferably the inner ends of the upper portion of the legs are provided with enlarged portions which are captivated by the spaced abutment nodes, such as 91 and 93 to releasably hold the same. The lower ends of the legs are preferably provided with suction cups as at 97 and 98 and support the plate means at a predetermined height above a support surface so that the reciprocating movement of the plunger is adapted to launder clothes when placed within the bag together with soap and water. As an alternative, a motor 101 with a switch means 106 and a supply current conductor 107 may be provided. The drive shaft 108 of this motor is connected through a transmission means composed of gears 110 and 112 to drive the device electrically if the handle 51 is removed from the socket 46.

Figure 4:
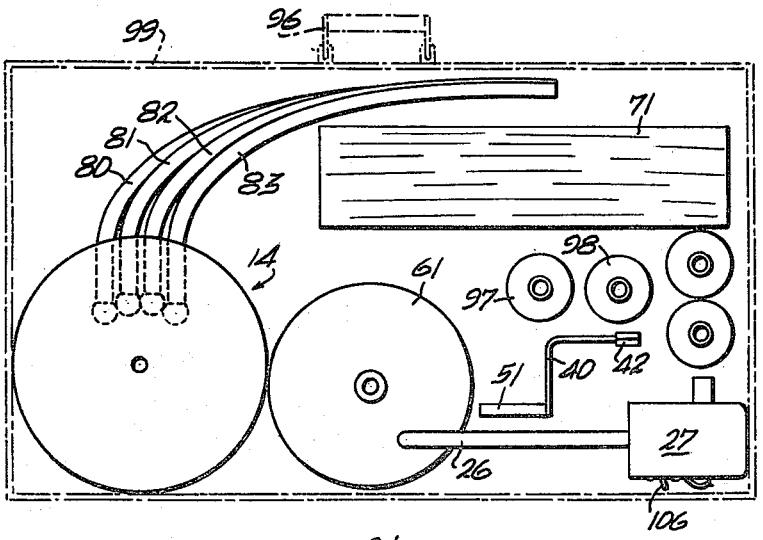
FIG. 4 is a view of the device in a knocked-down condition and stored within a carrying case or container having a handle.

It is thus seen that there has been provided a simple and inexpensive device which is adapted to be knocked-down as shown in FIG. 4 and carried in a container 99 of a suitcase type having a handle 96.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A device to launder articles of clothing comprising, a frame comprising, a horizontal plate means, a plurality of spaced legs each having an upper end and a lower end, and said lower ends extending from the plate and supporting said horizontal plate means at a predetermined height, means to connect the upper ends removably to the plate means, and said plate means having a central through hole, a shaft slidably arranged in the hole, said shaft having an upper portion extending above the plate means and a lower portion extending below the plate means, a housing on the plate means and about the upper shaft portion, and means to secure the housing to the plate means, said housing defining a chamber, a drive means in the chamber and carried by said housing, said drive means including a drive transmission including gears and a crank arm, connector means interconnecting the upper portion of the shaft and the crank arm for reciprocal movement of the shaft relative to the hole when the drive means is operated.

plunger means fixed to the lower end of the shaft, and a closed water pervious bag removably arranged about said shaft adjacent the lower end and adapted to hold soapy water, said plunger being within said bag and adapted for reciprocal laundering motion.

2. The device as set forth in claim 1 wherein foot means are provided on said lower leg ends.

3. The device as set forth in claim 1 wherein said plate means comprises a first and a second plate and said upper ends of said legs are sandwiched between said plate.

4. The device as set forth in claim 1 wherein said frame, legs, shaft and housing are separable from one another and adapted for storage within a container, said container having a handle for carrying the same.

5. The device as set forth in claim 1 wherein said drive means comprises a hand crank extending from the housing.

6. The device as set forth in claim 1 wherein the drive means comprises an electric motor.

* * * * *

UNITED STATES PATENT OFFICE

CERTIFICATE OF CORRECTION

Patent No. 4,305,265 Dated December 15, 1981

Inventor(s) Marcelo Burgas

It is certified that error appears in the above-identified patent and that said Letters Patent are hereby corrected as shown below:

On the title page, Item [76] should read:
Inventor: --Marcelo Burgos--

Signed and Sealed this

*Twentieth* Day of *April 1982*

[SEAL]

*Attest:*

GERALD J. MOSSINGHOFF

*Attesting Officer*

*Commissioner of Patents and Trademarks*